United States Patent [19]

Onal

[11] 4,004,541

[45] Jan. 25, 1977

[54] JET BOAT PUMP

[75] Inventor: Hasan F. Onal, Denver, Colo.

[73] Assignee: Hydro-Tech Corporation, Denver, Colo.

[22] Filed: July 28, 1975

[21] Appl. No.: 599,535

Related U.S. Application Data

[63] Continuation of Ser. No. 382,374, July 25, 1973, abandoned.

[52] U.S. Cl. ..... 115/12 R; 115/14; 416/184

[51] Int. Cl.[2] ..... B63H 11/04; B63H 11/10

[58] Field of Search ..... 115/11, 12 R, 12 A, 115/14, 16; 60/220–222; 415/98, 106; 416/184, 186, 188, 199

[56] References Cited

UNITED STATES PATENTS

| | | | |
|---|---|---|---|
| 2,700,344 | 1/1955 | Schellens | 415/106 |
| 2,791,183 | 7/1957 | Ygge | 416/184 |
| 3,034,295 | 5/1962 | Hanley | 115/12 R |
| 3,114,239 | 12/1963 | Aylor | 115/12 R |
| 3,212,258 | 10/1965 | Gongwer | 115/16 |
| 3,246,605 | 4/1966 | Fisher | 415/98 |
| 3,247,667 | 4/1966 | Adams et al. | 115/12 R |
| 3,422,788 | 1/1969 | Horan, Jr. | 115/12 R |
| 3,536,417 | 10/1970 | Stiefel et al. | 416/188 |
| 3,671,138 | 6/1972 | Ball | 415/98 |
| 3,740,162 | 6/1973 | Tuomaala | 415/98 |
| 3,809,005 | 5/1974 | Rodler, Jr. | 115/12 A |
| 3,935,833 | 2/1976 | Onal | 115/12 R |

*Primary Examiner*—George E. A. Halvosa
*Assistant Examiner*—Stuart M. Goldstein
*Attorney, Agent, or Firm*—Wegner, Stellman, McCord, Wiles & Wood

[57] ABSTRACT

A centrifugal pump for a boat which is used to propel the boat by means of a jet of water created by the pump. The pump includes a housing which is mounted exterior to the hull. A drive shaft and an impeller are mounted to rotate within the housing. The drive shaft extends through the transom of the boat and may be coupled directly to a gas turbine engine or other power generating device. The impeller is of the double suction type and includes ports for equalizing pressures on either side of the impeller at the suction positions thereof. The housing provides a double volute to receive the effluent from the impeller and direct it aft to a nozzle. Nozzle mechanisms are disclosed which provide easy steering and boat trim control under high thrust loads. A thrust reversal system is employed which directs the jet of water forward for stopping and reversing. A new scoop design is also included which reduces the possibility of air entrapment and loss of suction and increases the ram jet pressure for higher pump efficiency.

11 Claims, 14 Drawing Figures

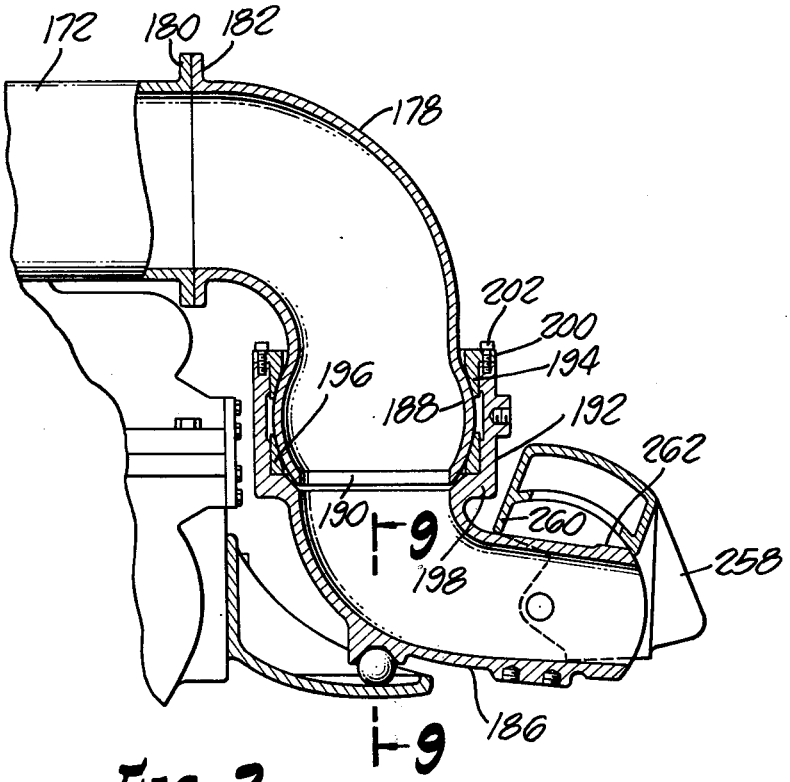
FIG. 7.
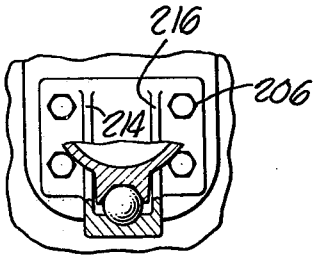
FIG. 9.
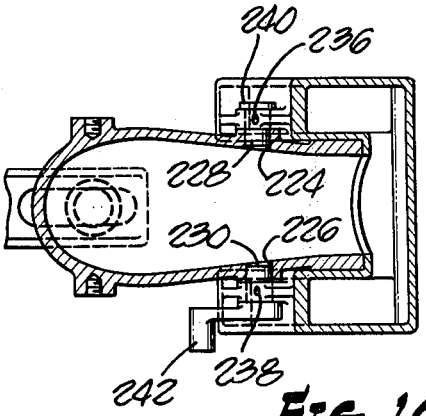
FIG. 10.
FIG. 8.
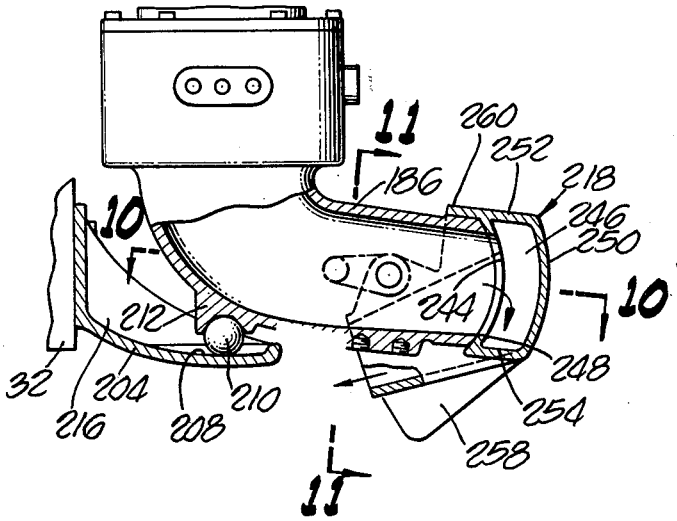
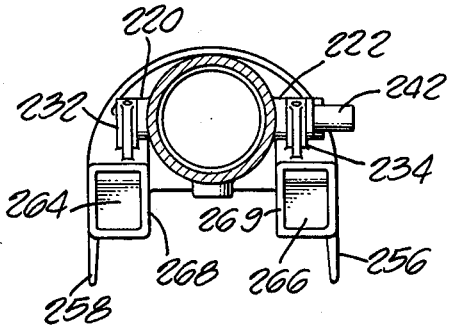
FIG. 11.

JET BOAT PUMP

This is a continuation application of application Ser. No. 382,374, filed July 25, 1973, now abondoned.

This invention is directed to a jet boat pump. More specifically, this invention is directed to an efficient and compact jet boat pump which is mounted to the transom of the boat.

Jet boats have been commercially available for several years. These boats employ high output pumps which suck water from beneath the boat and exhaust it aft through a nozzle. A major problem which has heretofore plagued these power systems is the amount of power consumed by the pump and not transmitted into motive force. This is due to the lack of suction pressure required for efficient operation of such pumps. These conventional pumps are axial mixed flow pumps which require around a 30° suction entrance approach. As a result of this shallow entrance angle these conventional pumps are not adaptable to be mounted on the boat transoms. Inboard placement of these pumps requires that the intakes be placed through the hull. Consequently, special boat designs have been necessary which have made any subsequent change in power systems impractical. Further, less cockpit space is available on these conventional systems because of the inboard placement of these pumps.

The present device incorporates a novel high speed, high capacity impeller having vanes which each present a low lead angle at the leading edge of the vane near the impeller shroud. This lead angle varies continuously across the leading edge of the vane to a substantially larger lead angle at the impeller hub. Further, the impeller and pump case provide a double suction, double volute system whch operates to balance the hydraulic and dynamic forces within the pump. Pressure equalizing holes also act to help balance the hydraulic pressures within the pump. As a result of these features, the present pump is substantially more efficient than the pumps previously employed for propelling jet boats. The dynamic and hydraulic balancing of the impeller also reduces the need for high capacity bearing mechanisms for support of the impeller and shaft. Further, the impeller reduces the required suction head and allows a greater entrance angle. Conventional pumps require this shallow entrance angle for development of dynamic pressure due to the motion of the boat through the water of 20 psig at the suction side of the impeller. The impeller design of the present pump can run without detrimental cavitation at atmospheric pressure. The increased efficiency, the reduction in mechanical complexity of the present system, and the increased entrance angle reduces the size of the pump so that it may be placed exterior to the hull. This outboard mounting of the pump of the present invention requires a minimum of hull modification and results in maximum utilization of the cockpit area. The efficiency of the present unit also reduces the size and the fuel consumption of the required power plant.

The double volute exhaust system results in a single output jet which is employed to both propel and steer the boat. A system for reversing the thrust of the jet is also disclosed. These systems provide increased control over the boat through the efficient use of the jet. Further, the inlet to the pump is located behind and below the hull to better maintain suction and increase ram jet pressure recovery.

Accordingly, an object of the present invention is to provide an efficient and compact outboard pump for driving a jet boat.

A second object of the present invention is to provide a pump to be used for propelling a jet boat which includes a dynamically and hydraulically balanced high output impeller in a double suction, double volute system.

Another object of the present invention is to provide an exhaust nozzle and reversal system for optimum use of the developed jet.

A further object of the present invention is to provide an inlet design which promotes rapid suction recovery and increases pump efficiency.

Further objects and advantages of the present invention will be made readily apparent from the following detailed description and accompanying drawings.

FIG. 7 is a cross-sectional elevation of the outlet nozzle, steering joint and reversal mechanism.

FIG. 8 is a side view of the nozzle with a portion thereof in cross-section illustrating the reversal mechanism in position.

FIG. 9 is a cross-sectional detail taken along line 9—9 of FIG. 7.

FIG. 10 is a cross-sectional plan view taken along line 10—10 of FIG. 8.

FIG. 11 is a cross-sectional elevation taken along line 11—11 of FIG. 8.

Figure 1:
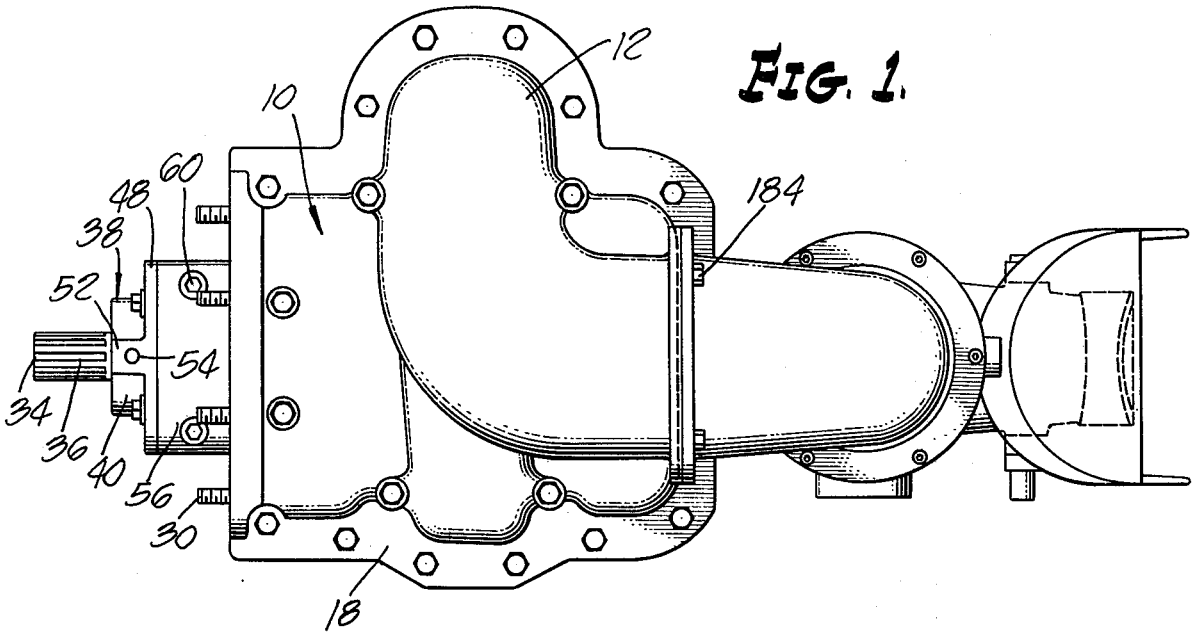
FIG. 1 is a top view of the present invention.
Figure 2:
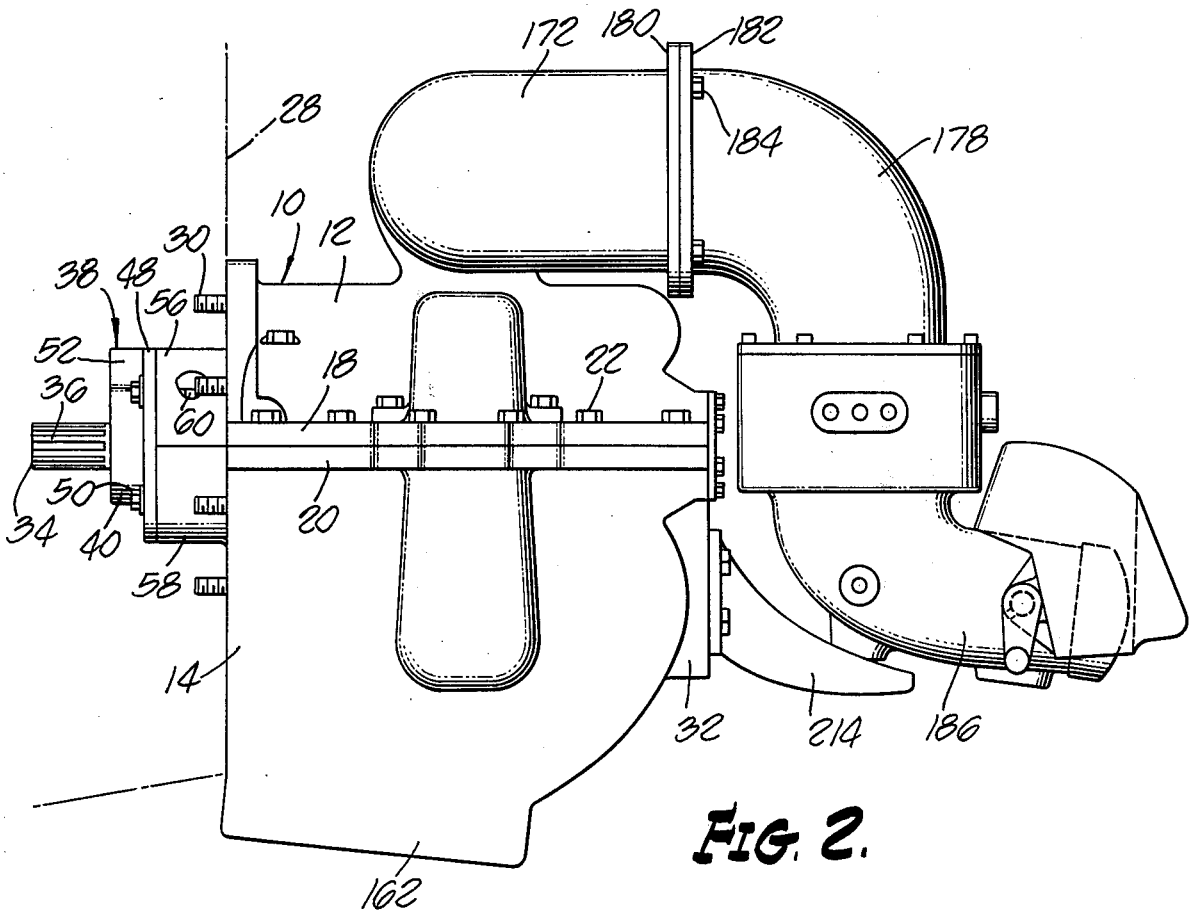
FIG. 2 is a side view of the present invention.
Figure 3:
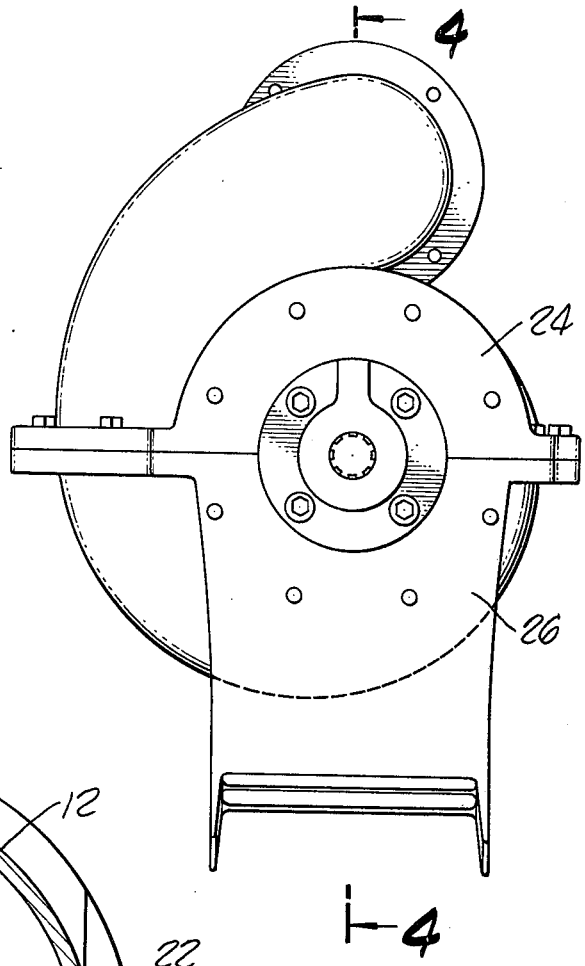
FIG. 3 is a front view of the present invention.
Figure 6:
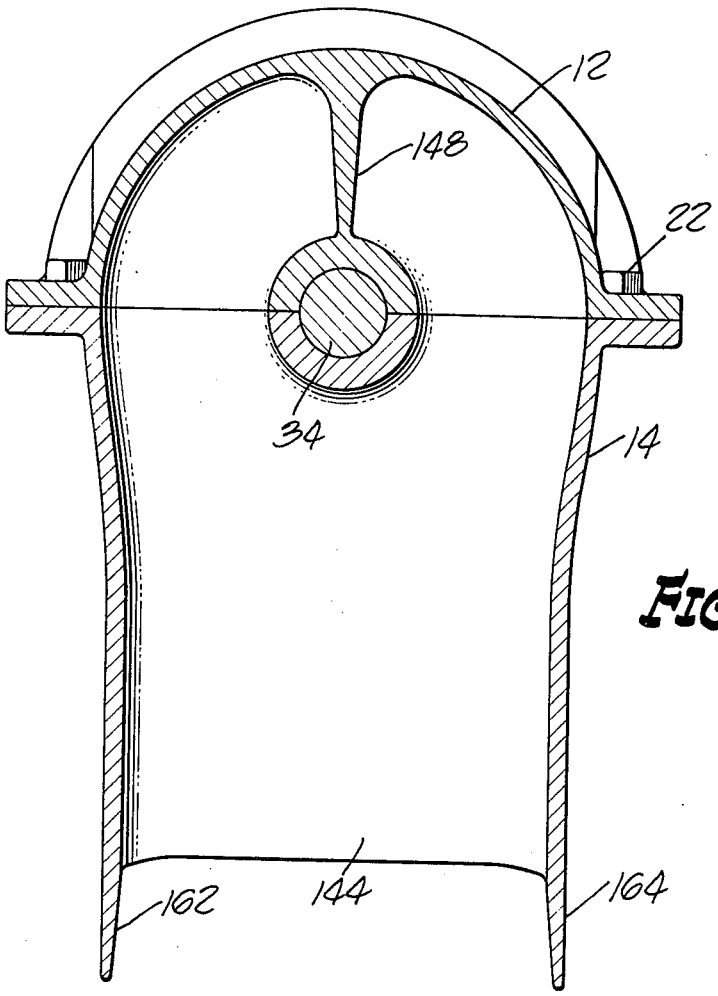
FIG. 6 is a cross-sectional elevation taken along line 6—6 of FIG. 4.
Figure 4:
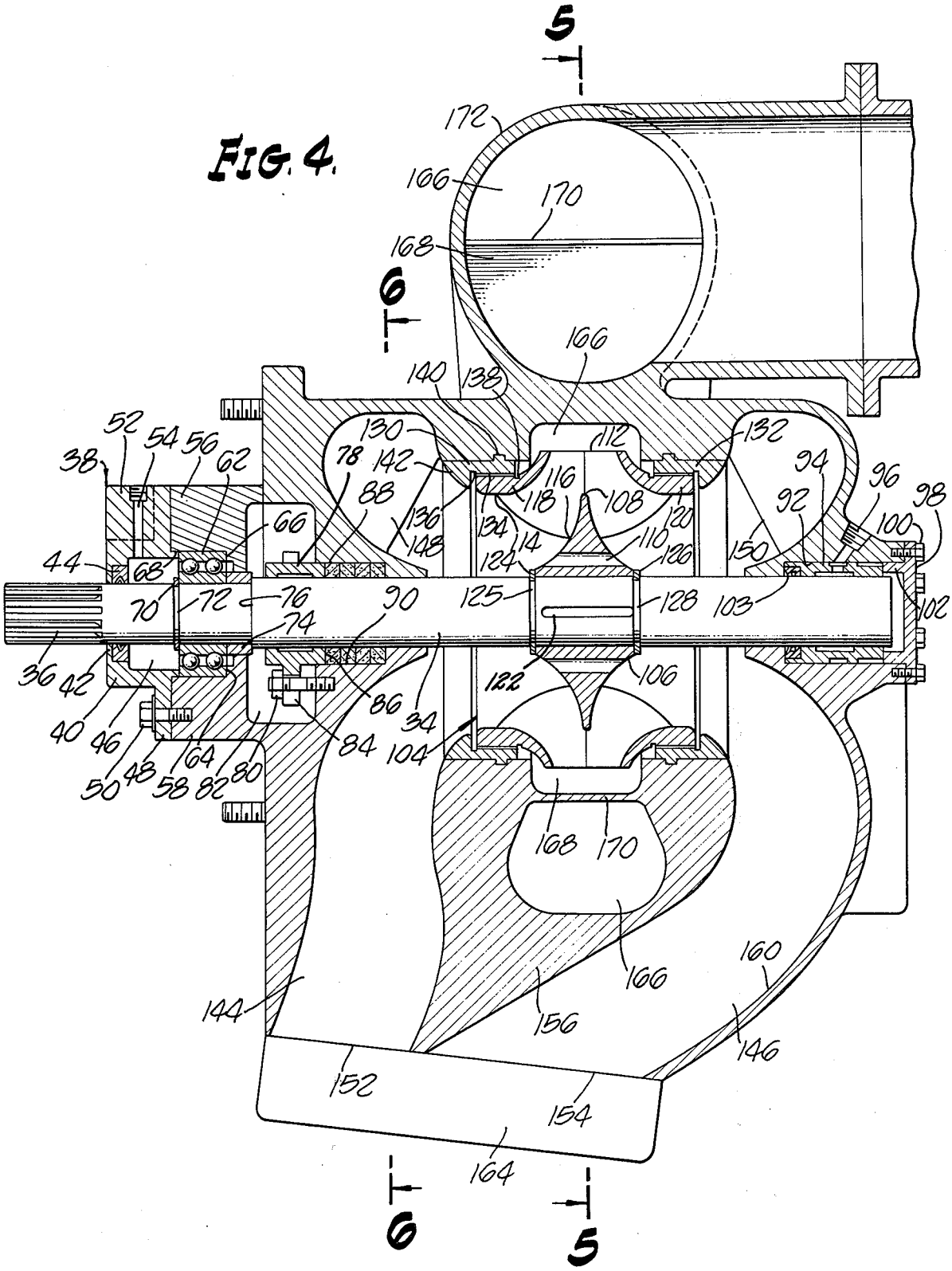
FIG. 4 is a cross-sectional side view taken along line 4—4 of FIG. 3.

Turning specifically to the drawings, a horizontally split case generally designated 10 is disclosed. The case consists of an upper section 12 and a lower section 14. Flanges 18 and 20 are provided about the mating edges of the case sections 12 and 14 for placement of fasteners 22. A substantial number of fasteners are employed because of the pressure which is developed within the case 10 that would otherwise tend to force the case sections 12 and 14 apart. This would result in leaks and possible failure. Fasteners are also placed at other convenient locations to tie the sections together. The upper section 12 and the lower section 14 include flat mating surfaces 24 and 26, as best seen in FIG. 3 which are juxtaposed with the transom of the boat. A boat hull 28 is shown in plantom in FIG. 2. This placement illustrates the most advantageous position of the pump relative to the boat. However, where it is desired, the pump may be placed within the hull of the boat. Studs 30 extend from the surfaces 24 and 26 for easy attachment to the transom. A web 32 is provided at the back of the lower casing segment 14 for added structural support and as a mount for nozzle supports and control.

A shaft 34 extends through the housing 10 at the partline between sections 12 and 14. The shaft 34 is coupled at splines 36 to the engine of the boat. The coupling may be a direct drive to a turbine or more conventional power plant. The impeller and the drive shaft 34 is constrained to rotate along a fixed axis through the pump case 10 by means of bushings and bearings. A bearing cap 38 is positioned at the front of the pump about the shaft 34 and includes a generally circular housing 40 with a closed end 42 through which the shaft 34 extends. The bearing cap 38 includes a conventional seal 44 about the drive shaft 34 and set within the closed end 42. The seal 44 is inset into the front end of the bearing cap 38 to retain the placement of the seal. A cavity 46 is formed within the circular housing 40 of the cap 38. A flange 48 extends about the periphery of the housing 40. Fasteners 50 are employed to secure the bearing cap 38 to the pump. A boss 52 extends upward from the cylindrical housing 40 and has a lubrication port 54 located therethrough. The lubrication port 54 is in communication with the cavity 46 for lubrication of the bearings.

A semi-circular bearing cover 56 is positioned between the bearing cap 38 and the upper section 12 of the case 10. An extension 58 of the lower section 14 of the case 10 extends forward from the main body of the case 10 and mates with the semi-circular bearing cover 56. The semi-circular bearing cover 56 is fastened to the case extension 58 by fasteners 60 vertically placed through the cover 56 into the extension 58. The extension 58 and the cover 56 act in combination to fix the position of a bearing 62 which is employed to support and constrain the drive shaft 34. The bearing 62 is preferably of the thrust type and operates to prevent axial movement of the drive shaft 34 within the pump case 10. The bearing 62 is positioned relative to the case 10 by means of a shoulder 64 which extends inwardly from the bearing seal on the extension 58 and by a similar shoulder 66 positioned on the bearing cover 56. Axial motion of the bearing 62 forward relative to the pump case 10 is prevented by a lip 68 which extends in from the flange 48 to secure the bearing 62 against the shoulder 64 and 66.

The drive shaft 34 is axially positioned relative to the bearing by a snap ring 70 positioned within a groove 72 in the shaft 34. On the other side of the bearing 62 from the snap ring 70, a collar 74 is positioned about the drive shaft 34. The collar 74 extends between the bearing 62 and a position 76 on the shaft 34 where the shaft diameter increases. As a result, the collar 74 acts as a spacer between the bearing 62 and the discontinuity 76 in the shaft 34. The collar 74 may be allowed to rotate with the shaft 34 and the inner race of the bearing 62.

Located interior to the bearing assembly is a packing cover 78. The packing cover 78 is secured to both the upper and lower case sections 12 and 14 by fasteners 80. A cavity 82 is provided by the case 10 and the bearing cover 56. Where the space 82 is such that the packing cover 78 cannot be withdrawn from the fasteners 80, slots 84 may be used to engage the fasteners 80. The packing cover 78 extends around the shaft 34 and includes a flat surface 86 which retains packing material 88 in position in the case 10. The packing material 88 prevents the passage of moisture along the shaft 34 into the bearing assembly. A cylindrical cavity 90 is provided in the case 10 to receive the packing material 88.

A rear bushing assembly is provided to prevent lateral motion of the aft end of the drive shaft 34. A cylindrical cavity 92 is provided in the case 10 for receipt of a bushing 94. The bushing 94 may be an oil or grease lubricated bronze bushing. A lubrication port 96 is provided for communication with the lubricated bushing 94. An end cap 98 is bolted to the aft end of the casing 10 by fasteners 100. The cap 98 includes a circular lip 102 which extends inwardly to lock the bearing 94 in position. A seal 103 is provided to prevent seawater from entering the journal bearing area.

An impeller 104 is employed for providing energy to the incoming water to form the propulsive jet. The impeller 104 is of the double suction type and includes a central hub 106. The central hub 106 extends from the shaft 34 radially outward to a circular rim 108. Holes 110 extend through the central hub 106. Six such holes 110 are shown in the present embodiment. These holes 110 operate to balance the difference in pressures between the two sides of the impeller 104. These pressures may result from variations in the dynamic pressure head caused by the forward motion of the boat. Integrally formed with the central hub 106 are vanes 112. There are six vanes 112 on each side of the central hub 106 in the present embodiment.

The impeller 104 is designed for use with a 300 hp. powerplant. Naturally, the pump may be employed with a range of powerplants and the impeller configuration will vary accordingly. Each vane 112 has a lead angle of 13° at the leading edge of the vane 112 adjacent the shroud at a position designated 114. The lead angle varies continuously across the leading edge of each vane 112 to a position adjacent the hub 106 designated 116 where the lead angle is 20° 30′. At the discharge position of the vane 112, the lead angle is 23°. The discharge position of each vane 112 at the shroud lags behind the leading edge by 105°. The inside back corner of the vane at the position 116 lags the outside back corner at the shroud at position 114, by 6°. The overall diameter of the impeller 104 is chosen to be 8 inches. The circular rim 108 of the central hub 106 has a diameter of 5¾ inches as does the position 114. Position 116 has a diameter of 3⅝ inches. The thickness of each vane varies from ⅛ inches near the leading edge to 5/32 inches generally along the vane. Shrouds 118 and 120 are positioned outside the vanes 112. The shrouds 118 and 120 have an inner diameter of 5 ¾ inches. and extend outwardly to the periphery of the impeller at a diameter of 8 inches. The relative eye area between the vanes 112, the central hub 106 and the shrouds 118 and 120 is approximately 1.2 square inches. This gives a total relative eye area with 12 vanes of 14.4 square inches. When driven at 4400 RPM, the impeller is capable of pumping 3400 GPM at an exit velocity of 23.97 feet per second.

To transfer power from the engine to the impeller 104, the impeller is fixed to rotate with the shaft 34. The shaft 34 and the impeller 104 may be constrained to rotate together by means of a key. Slot 122 is provided in the shaft 34. A slot (not shown) is also provided in the impeller hub 106. A key and shim (not shown) are positioned in the slots. The impeller 104 is also held from moving axially forward on the shaft 34 by a snap ring 124 positioned in groove 125 of the shaft 34. To prevent axial movement backward on the shaft 34, a snap ring 126 is positioned in groove 128 immediately behind the impeller 104.

The impeller 104 and case 10 are designed for hydraulic and dynamic balance. The impeller 104 is a double suction impeller and distributes water to a double volute system. The holes 110 allow an equalizing of inlet pressures on either side of the impeller 104. Further, the high number of vanes provides a fairly continuous flow pattern with balanced reaction loads on the impeller 104. Consequently, the amount of vibration experienced by the pump is substantially reduced over unbalanced systems. The resulting bearing requirements are also reduced because the pump is hydraulically balanced; there are no significant hydraulic or dynamic forces acting against the thrust bearings. The double suction arrangement also is advantageous to the present system because of the larger eye area which is twice as large as the conventional single suction, mixed flow impellers of comparable size. Thus a cavitation condition is avoided.

Two wear rings 130 and 132 are provided about the shrouds 118 and 120 of the impeller 104. These rings 130 and 132 minimize flow from the discharge side of the impeller to the suction side of the impeller. Each wear ring 130 and 132 includes an accurately machined wear surface 134 which is exterior to the impeller shrouds 118 and 120 which are also accurately machined. A groove 136 is cut into each wear ring 130 and 132 adjacent the wear surface 134 to prevent the formation of a ridge as the portion of the wear surface 134 which contacts the impeller shrouds 118 and 120 is worn away. A similar groove 138 is provided on each of the shrouds 118 and 120 for the same reason. Both the outer surfaces of the shrouds and the machined surfaces 134 of the wear rings 130 and 132 may have oppositely oriented spiral grooves. These spiral grooves prevent the parts from freezing together during dry operation. The wear rings 130 and 132 also include an annular ridge 140 which extends into a corresponding groove in the casing 10. The ridge 140 prevents lateral movement of the wear rings 130 and 132. The annular ridge 140 extends continuously about the outer side of each of the wear rings 130 and 132 except for a small space on one point at the wear ring circumference where the annular ridge 140 is removed. At this point, the groove associated with the ridge 140 is also broken. This break in the groove prevents the ridge 140 from sliding along the groove. As a result, the ridge 140 prevents both lateral and rotational movement of each of the rings 130 and 132. The wear rings 130 and 132 also each include a shoulder 142 which is spaced from the rotating impeller 104 but which forms a semi-continuous path from the case 10 to the inner side of each of the shrouds 130 and 132. This prevents major disturbances of the incoming flow.

As the impeller is of the double suction type, the casing 10 includes two inlet passages 144 and 146. These passages 144 and 146 extend upward around the shaft 34 to baffles 148 and 150 respectively. By extending the inlet passages 144 and 146 upward about the shaft 34, the inlet entrance will surround the shaft 34 and provide influent to the total inlet area of both sides of the impeller 104. The baffles 148 and 150 help prevent pre-rotation of the incoming water in front of the impeller vanes, thereby increasing the pump efficiency.

At the base of the inlet channels 144 and 146, two suction ports 152 and 154 are provided. The suction ports are divided, as are the lower portions of the channels 144 and 146 by an extension 156 of the casing 10. The suction ports 152 and 154 are angled downward toward the back of the casing 10. This provides better flow of the incoming water into the ports 132 and 134. The water is scooped into the suction ports 152 and 154 by the forward motion of the boat and the pump through the water. The aft surfaces 158 and 160 are curved to provide a more gradual transition for the water being forced into the ports 152 and 154. The action of the impeller 104 causes a reduction in the absolute pressure in the inlet passages 144 and 146. This reduction in pressure cooperates with the dynamic pressure created by the motion of the pump through the water to force influent into the impeller 104.

It is preferred that the suction created by the action of the impeller 104 and the dynamic head created by the motion of the pump through the water can be maintained. When the suction ports 152 and 154 are allowed to come out of the water, the dynamic head and the impeller suction is lost. This results in a loss of thrust from the pump. To overcome the loss of suction caused by the ports 152 and 154 rising out of the water, sidewalls 162 and 164 extend along the sides of the suction ports 152 and 154. These sidewalls 162 and 164 prevent air from passing through the suction ports 152 and 154 from the side. The sidewalls 162 and 164 do not extend across the front of the casing 10 or the back of the casing 10. Thus, water is allowed to move freely from front to back across the suction ports 152 and 154. The angle on the inlet ports is designed to increase the ram effect of the scoop passing through the water. The angle of the port relative to the centerline of the shaft 104 is approximately 6°.

Figure 5:
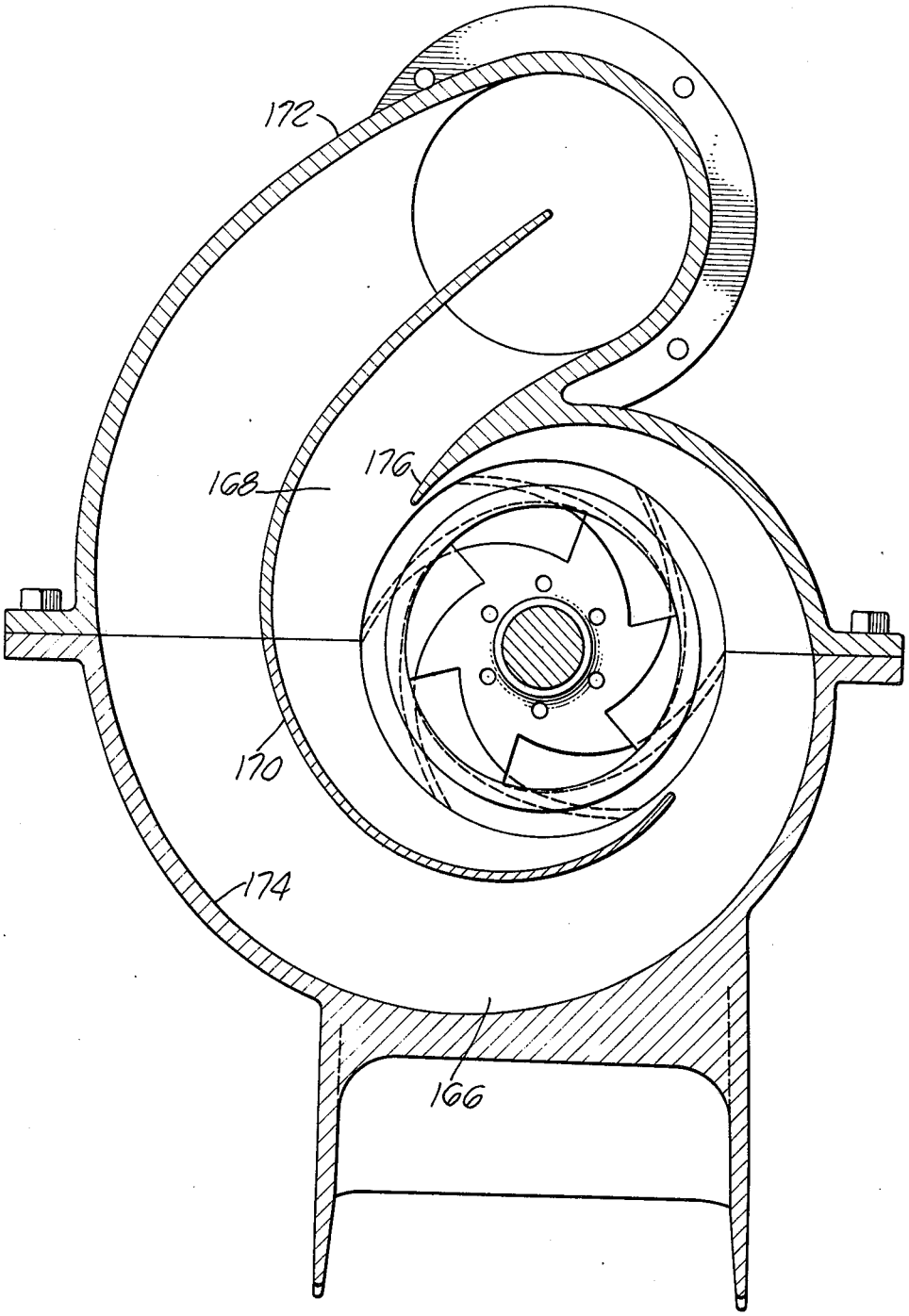
FIG. 5 is a cross-sectional elevation taken along line 5—5 of FIG. 4 with an unsectioned impeller in place.
Figure 12:
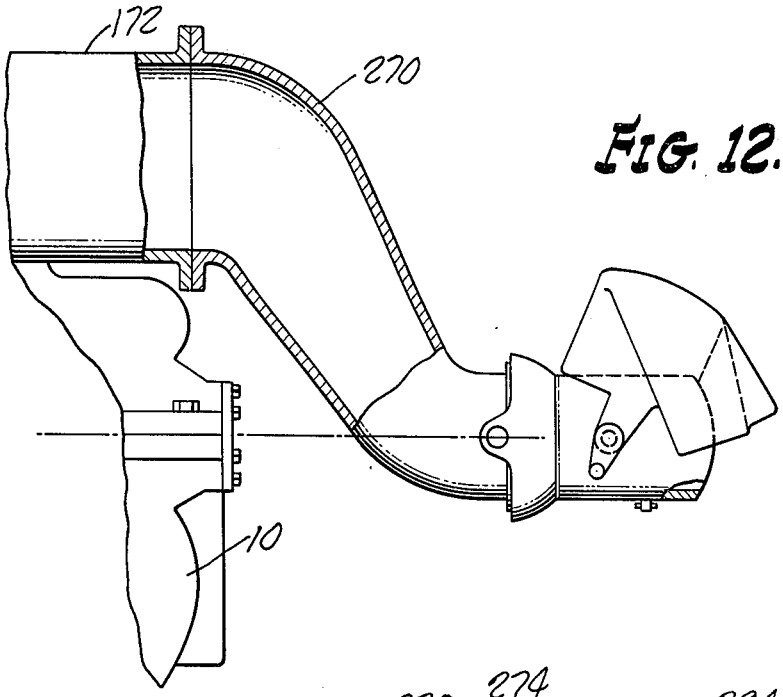
FIG. 12 is a side view of an alternate nozzle configuration.
Figure 13:
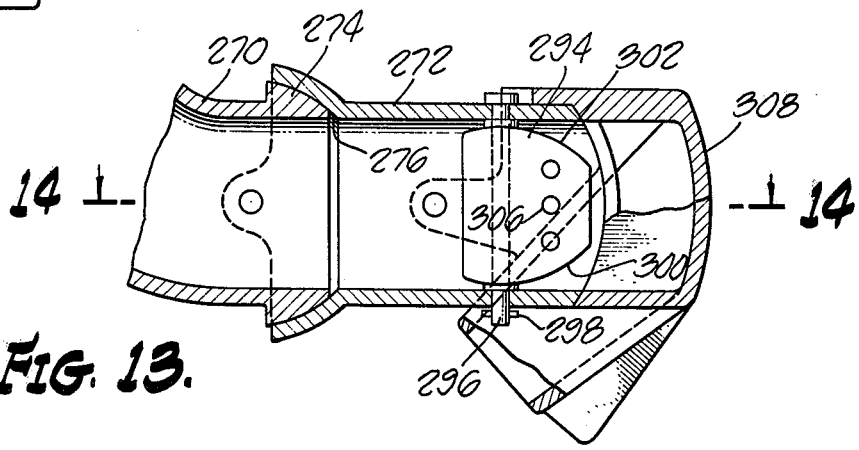
FIG. 13 is a side view of the alternate nozzle configuration of FIG. 12 taken in cross-section through the center thereof.
Figure 14:
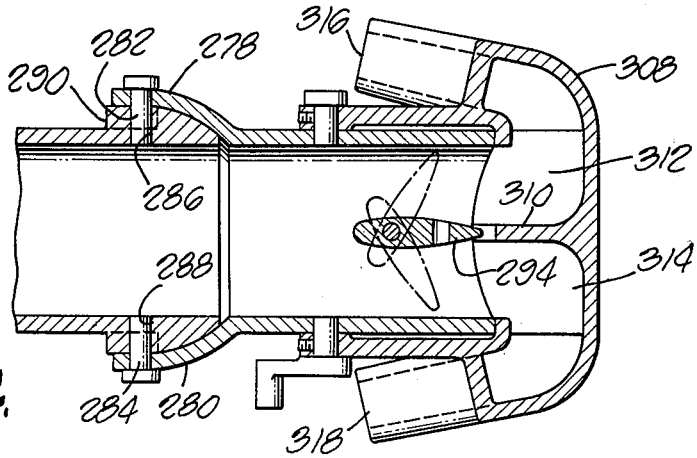
FIG. 14 is a cross-sectional top view taken along line 14—14 of FIG. 13.

Once the water is passed from the inlet passages 144 and 146 into the impeller 104, the water is forced radially outward into two volutes 166 and 168. The configuration of the two volutes is best seen in FIG. 5. Two volutes are employed to create opposite pressures which are nearly equal about the periphery of the impeller 104. This results in a balance of forces on the impeller. The two volutes 166 and 168 are separated by a wall 170 which is part of the casing 10. The wall 170 extends from the leading end of the inner volute 168 immediately adjacent the outer periphery of the impeller 104 to a single outlet conduit 172 to form the volute 168. The other outer volute 166 is formed by the outer side of the wall 170 and the inner side 174 of the outer wall of the casing 10. The casing extends inwardly to a position immediately adjacent the outer periphery of the impeller 38 and 176.

The effluent received from the impeller 104 by the volutes 166 and 168 is passed through the outlet conduit 172 which forms the uppermost portion of the casing 10. The outlet conduit 172 receives water from the two volutes 166 and 168 which are disposed in a plane perpendicular to the centerline of the shaft 34 and directs the stream of water aft parallel to the centerline of the shaft 34.

When the pump is used competitively for boat races and the like, a straight nozzle may be provided behind the outlet conduit 172. When the pump is used for noncompetitive purposes, it is advantageous that the jet exhaust near the water line to avoid blasting skiers with the jet. In one embodiment, a guidance elbow 178 is coupled with the case 10 to extend the exhaust conduit 172 downward. Flanges 180 and 182 are provided on the case 10 and the guidance elbow 178 at the joint thereof. Conventional fasteners 184 may be employed to lock the guidance elbow 178 to the case 10. The guidance elbow 178 directs the stream of water exhausting through the exhaust conduit 172 downwardly behind the pump to a position near the water level. The flow nozzle 186 receives the stream of water from the guidance elbow 178 and directs it rearward to exhaust in a jet. Because of the double suction, double volute design, which is inherently more stable than the conventional mixed flow pumps, and because of the wall 170 between the volutes extends to the exhaust end of the outlet conduit 172 to minimize vortex motion, the rooster tail effect is greatly reduced.

A ball and socket joint is formed between the guidance elbow 178 and the flow nozzle 186 to provide steering through an articulated nozzle. A ball 188 is formed at the lower end of the guidance elbow 178 which is open at the lower end 190 for passage of the water jet. A socket 192 is provided at the upper end of the flow nozzle 186. This socket 192 is substantially cylindrical and easily accommodates the ball 188 on the guidance elbow 178. Circular bushings 194 and 196 are placed within the cylindrical socket 192 to keep the ball and socket in position. Both the upper bushing 194 and the lower bushing 196 taper to accommodate the shape of the ball 188. The lower bushing 196 is held within the socket 192 by the ball 188. The socket 192 includes a bottom 198 which supports the lower bushing 196 and allows the flow nozzle 186 to neck inward to an inner diameter approximately equal the diameter of the hole 190 through the bottom of the ball 188. The upper bushing 194 includes an annular flange 200 which mates with the top of the socket 192. The annular flange 200 is fastened to the socket 192 by conventional fasteners 202 located about the periphery of the bushing 194. The ball and socket joint allows the flow nozzle 186 to freely pivot about the centerline of the cylindrical socket 192. The ball and socket arrangement also allows certain motion of the flow nozzle about a horizontal axis under the high thrust loads. Further, the ball and socket arrangement does not impede the flow of the output stream of water from the pump.

The flow nozzle 186 terminates in a nozzle configuration which may be optimized for specific flow rates and pressures of the effluent using established nozzle theory. The nozzle 186 directs the jet aft at an angle which is most efficient considering the trim of the boat, the vector force directions of the exhausting jet, and the wake characteristics created.

A nozzle support bracket 204 is rigidly fixed to the web 32 by fasteners 206. The nozzle support bracket 204 includes a track 208 in which a ball 210 is positioned. An open socket 212 is provided on the flow nozzle 186 to receive the ball 210 and keep it positioned relative to the flow nozzle 186. The track 208 extends fore and aft and is wide enough to receive the ball 210. Support webs 214 and 216 are provided on either side of the track 208 for added structural support of the bracket 204. The support webs 214 and 216 are curved to avoid interference with the motion of the flow nozzle 186 and are spaced apart to avoid interference with the open socket 212 on the flow nozzle 186.

The combination of the ball and socket joint between the guidance elbow 178 and the flow nozzle 186 and the track 208 in the bracket 204 allows limited motion of the flow nozzle 186 about a horizontal axis perpendicular to the centerline of the shaft 34. As a result, under high thrust conditions, the flow nozzle 186 will pivot downward. This is advantageous for boat trim at high speeds.

A reversal means is provided with the articulated nozzle configuration which acts to direct the jet of water forward. To reverse the jet of water, a control gate generally designated 218 is employed in the present invention. The control gate 218 is pivoted about a horizontal axis on the flow nozzle 186. To provide this pivot axis, bosses 220 and 222 extend horizontally outward from the flow nozzle 186. Holes 224 and 226 are drilled through the bosses 220 and 222. Pins 228 and 230 are positioned within holes 224 and 226 to form a pivot axis for the control gate 218. The pins 228 and 230 cooperate with clevis lugs 232 and 234 which are rigidly positioned on the control gate 218. The clevis lugs 232 and 234 are spaced to slidably fit over the bosses 220 and 222. The pins 228 and 230 are held fixed within the clevis lugs 232 and 234 by set screws 236 and 238. The pins 228 and 230 thereby extend inward and are constrained to rotate within the holes 224 and 226. Pin 228 includes a head 240 which, when positioned against the clevis lug 232, properly positions the pin 228 within the hole 224. On pin 230, a handle 242 is provided. The handle 242 may be used to actuate the control gate 218. The handle 242 also operates to properly position pin 230.

The control gate is shown rotated out of the way in FIG. 7. When the control gate 218 is rotated from in front of the nozzle 186, the thrust propels the boat forward. FIG. 8 illustrates the control gate 218 positioned behind the flow nozzle 186. When so positioned, the jet of water is directed through a control gate inlet port 244 into a distribution channel 246 located within the body of the control gate 218. The channel 246 is defined by an inner wall 248, an outer wall 250, a top 252 and a bottom 254. The inner wall 248 is curved to approximate the curvature of the outlet end of the flow nozzle 186. The control gate inlet port 244 extends through the inner wall 248. The outer wall 250 is also curved to approximate the curvature of the inner wall 248 to provide a uniform width to the channel 246. The bottom 254 extends between the inner wall 248 and the outer wall 250 to cause the jet to move outwardly in either direction between the inner wall 248 and the outer wall 250. The top 250 is circular and extends over the entire control gate 218 and terminates in fins 256 and 258. The circular top 252 also extends forward in a flange 260. Flange 260 mates with a shoulder 262 on the flow nozzle 186 when the control gate 218 is lowered into the reversing position. The channel 246 directs the jet of water outwardly in either direction to two reversing nozzles 264 and 266. The reversing nozzles 264 and 266 are formed from extensions of the circular top 250 which extends down about the control gate 218. The inner walls 268 and 269 of the control nozzles 264 and 266 are positioned to mate with the shoulder 262 on the outlet end of the flow nozzle 186 as best seen in FIG. 10. When the control gate 218 is in the reversing position, the reversing nozzles 264 nd 266 are directed forward and downward to provide reverse thrust and at the same time direct the resulting jets away from the pump case 10.

An alternate embodiment may be employed for using the jet as a means for steering the boat. Instead of an articulated nozzle, a deflector vane within the jet is employed. An outlet elbow 270 is coupled with the case 10 to extend the outlet conduit 172. The outlet elbow 270 may be attached to the case 10 in a similar manner to the attachment of the guidance elbow 178 in the first embodiment. The stream of water exiting from the outlet conduit 172 is directed downward by the outlet elbow 270. The stream is then directed aft to a nozzle 272. The nozzle 272 is attached to the outlet elbow 270 at a pivoted joint assembly. The outlet elbow 270 terminates in a cylindrical conduit having a shoulder 274 extending about the exterior of the outlet elbow 270. The shoulder 274 forms a section of a spherical surface having a centroid at the center of the axis of rotation of the joint. The nozzle 272 has a mating interior surface 276 which is capable of pivoting about the spherical surface of shoulder 273. Clevis lugs 278 and 280 extend from the mating portion of the nozzle 272 to engage pins 282 and 284 which extend into holes 286 and 288. The holes 286 and 288 are drilled through bosses 290 and 292. This spherical joint assembly allows the nozzle 272 to pivot about a horizontal plane perpendicular to the centerline of the boat; and thereby allows the nozzle to be rotated to enhance the trim of the boat.

Steering may be accomplished through the use of a deflector vane 294 located near the outlet end of the nozzle 272. The deflector vane 294 is pivoted about a vertical axis provided by pin 296. The pin 296 is retained in position by a retainer 298. The deflector vane 294 extends from the top to the bottom of the nozzle 272. In order that the deflector vane 294 can pivot in the circular nozzle, the upper and lower edges of the vane are curved at 300 and 302. The pivot axis extends lengthwise through the deflector vane 294 and is centered between the two sides of the deflector vane 294. Three holes 306 are provided through the downstream portion of the deflector vane 294. These holes 306 operate to enhance steering in reverse as will be explained below. The deflector vane 294 effects steering by deflecting the water jet. To execute a right turn, the deflector vane 294 is rotated counterclockwise as seen from above. The water on the right side of the jet is deflected toward the right. The water on the left side of the jet is naturally drawn along the surface of the deflector vane 294 and thereby also is directed toward the right.

A reversal system is also employed which uses the deflector vane 294. A control gate 308 very similar to the control gate 218 may be employed to reverse the jet. The control gate 308 varies from the control gate 218 by the inclusion of a center divider 310 which divides the channel 246 of the control gate 218 into two channels 312 and 314. Also, reversing nozzles 316 and 318 are angled outward 30° or more to create force vectors perpendicular to the boat centerline.

To effect a left turn in reverse which will rotate the boat in a counterclockwise direction, the deflector vane 294 is rotated in a counterclockwise direction to substantially cut off the flow of water along the right side of the nozzle. The speed of the jet is normally low when reversing. The deflector vane can be deflected under such conditions to substantially shut off the flow on one side of the stream. The holes 306 allow some of the water to pass on the restricted side of the stream. The holes create turbulence which causes the unrestricted stream to seek the easiest path away from the turbulence. The main stream thereby proceeds down the left side of the nozzle and tends to enter the channel 312. The turbulence created by the holes 306 also drives the main stream into the channel 312. The angle on the nozzle 314 causes the water to eject toward the left side of the boat. The resulting force tends to rotate the boat in a counterclockwise direction as well as propel it in reverse.

While embodiments and applications of this invention have been shown and described, it would be apparent to those skilled in the art that many more modifications are possible without departing from the inventive concepts herein described. The invention, therefore, is not to be restricted except as is necessary by the spirit of the appended claims.

I claim:

1. A pump for propelling a boat, comprising a pump housing having inlet passage means for receiving water and outlet passage means for discharging water;

a pump shaft rotatably mounted in said pump housing; and an impeller mounted concentrically on said pump shaft in said housing, said impeller being in communication with said inlet passage means and said outlet passage means;

said outlet passage means including an outlet channel, a nozzle operably joined with said outlet channel to allow rotation of said nozzle about a substantially vertical axis and about a substantially horizontal axis perpendicular to the center line of the boat, and support means comprising a support bracket mounted on said housing and having a track extending in a front to rear direction, a ball positioned in said track, and a socket on the nozzle holding said ball.

2. The pump of claim 1 wherein said outlet channel and said nozzle are joined about a common upright centerline, said socket being located on said upright centerline.

3. The pump of claim 1 wherein said outlet passage means further includes a reversing means, said reversing means being pivotally mounted on said nozzle so that said reversing means may be rotated in front of the outlet of said nozzle, said reversing means including an inlet for receiving the jet from said nozzle, a distribution channel perpendicular to the jet from said nozzle, and two outlet nozzles located at either end of said distribution channel, said outlet nozzles being directed forwardly and downwardly to be capable of moving said boat in reverse without the resulting jets of water impinging on the boat.

4. A pump as defined in claim 1 wherein said outlet passage includes a reversing means pivotally mounted on the nozzle for movement to a position directing the jet from the nozzle in a forward direction for moving the boat reversely.

5. A pump for propelling a boat, comprising a pump housing mountable on a boat with the bottom of the housing adjacent to the bottom of the boat, a pump shaft rotatably mounted in the pump housing on an axis extending in a front to rear direction and having one end adapted for connection with a source of power.

a pump impeller mounted on said shaft for rotation therewith including an axially directed entrance surrounding the shaft, a pump inlet channel opening at the bottom of the housing and communicating with the entrance to the pump impeller, a casing disposed around the pump impeller for receiving the discharge from the entire periphery of the impeller and having its discharge end located laterally at one side of the shaft including an inner volute having an entrance communicating with approximately one-half of the periphery of the pump impeller extending angularly circumferentially, and an outer volute having an entrance communicating with approximately the other half of the periphery of the impeller, an outlet channel communicating with said discharge end of said casing and extending approximately 90° around the impeller while turning approximately 90° rearwardly to a central rearwardly directed discharge nozzle.

6. A pump for propelling a boat, comprising a pump housing mountable on a boat transom with the bottom of the housing adjacent to the bottom of the boat, a pump shaft rotatably mounted in the pump housing on an axis extending in a front to rear direction and having one end adapted for connection with a source of power, a pump impeller mounted on said shaft for rotation therewith including an axially directed entrance surrounding the shaft, a pump inlet channel opening at the bottom of the housing adjacent the bottom of the boat and communicating with the entrance to the pump impeller for supplying water to the impeller without significant resistance to motion of the boat, a peripheral outlet chamber around the pump impeller including inner and outer volutes each having an entrance with the entrances circumferentially spaced around said pump impeller and extending beyond a vertical plane containing said pump shaft axis for receiving the discharge from the impeller radially and each volute terminating at the top of said pump housing, and an outlet channel communicating with said outlet chamber and including a rearwardly directed discharge nozzle.

7. A pump for propelling a boat, comprising a pump housing including means on the front thereof for mounting the housing on the back of a boat transom with the bottom of the housing adjacent to the bottom of the boat, a pump shaft rotatably mounted in the pump housing on an axis extending in a front to rear direction and having one end adapted for connection with a source of power, a double suction impeller mounted on said shaft for rotation therewith, including a first set of vanes having a forwardly directed entrance surrounding the shaft, and a second set of vanes having a rearwardly directed entrance surrounding the shaft, said two sets of vanes being of opposite hand with respect to each other, a first pump inlet channel opening at the bottom of the housing adjacent the bottom of the boat and communicating with the entrance to the first set of vanes and a second inlet channel opening at the bottom of the housing behind the first inlet channel adjacent the bottom of the boat and communicating with the entrance to the second set of vanes for supplying water to the impeller without significant drag resistance to motion of the boat, and a common peripheral outlet including inner and outer volutes with peripherally staggered inlets and each inlet extending beyond a vertical plane containing said pump shaft axis for receiving the discharge from both sets of vanes and terminating at the top of the pump housing and including at least one rearwardly directed discharge nozzle.

8. The device of claim 7 wherein the opening of said first channel is positioned in front of and above the opening of said second channel and both of said openings are directd forwardly.

9. The device of claim 7 wherein said inner volute communicates with approximately one-half the periphery of said impeller and said outer volute communicates with approximately the other half of the periphery of said impeller and the volute inlets extend approximately 45° beyond said vertical plane.

10. A pump for propelling a boat, comprising a pump housing having inlet passage means for receiving water and outlet passage means for discharging water;

a pump shaft rotatably mounted in said pump housing; and an impeller mounted concentrically on said pump shaft in said housing, said impeller being in communication with said inlet passage means and said outlet passage means;

said outlet passage means including an outlet channel, a nozzle attached to said outlet channel, a deflector vane pivotally mounted about a vertical axis located near the outlet of and at the centerline of said nozzle, and reversing means pivotally mounted to said nozzle to be capable of being positioned in the path of the jet from said nozzle, an inlet to said reversing means, a distribution channel located perpendicular to the direction of the jet from said nozzle, a center divider dividing said inlet and said distribution channel at the centerline of said nozzle, said center divider being substantially vertical, and tubular outlet nozzles located at either end of said distribution channel, said outlet nozzles being directed forwardly, downwardly and extending outwardly at a substantially constant angle from said distribution channel.

11. The device of claim 10 wherein said deflector vane includes holes located therethrough to enhance steering with said reversing means in position behind said nozzle.

* * * * *